United States Patent [19]

Balzano et al.

[11] 3,981,160

[45] Sept. 21, 1976

[54] NEEDLE SELECTING MEANS

[75] Inventors: Oberdan Balzano; Lando Dondoli, both of Florence, Italy

[73] Assignee: Billi S.p.A., Florence, Italy

[22] Filed: Apr. 29, 1974

[21] Appl. No.: 465,149

[30] Foreign Application Priority Data

Apr. 27, 1974 Italy ..... 9437/73

[52] U.S. Cl. ..... 66/50 R

[51] Int. Cl.[2] ..... D04B 9/00

[58] Field of Search ..... 66/50 R, 50 B, 25, 49, 66/75, 40

[56] References Cited

UNITED STATES PATENTS

| | | | |
|---|---|---|---|
| 1,779,239 | 10/1930 | Jones | 66/49 |
| 3,004,413 | 10/1961 | Felker | 66/50 B |
| 3,616,655 | 11/1971 | Guell | 66/50 B |
| 3,667,253 | 6/1972 | Bourgeois | 66/50 B |
| 3,726,111 | 4/1973 | Negri | 66/50 R X |
| 3,824,809 | 7/1974 | Canderton et al. | 66/50 R |
| 3,842,622 | 10/1974 | Muhlhausler et al. | 66/50 B |

FOREIGN PATENTS OR APPLICATIONS

| | | | |
|---|---|---|---|
| 1,578,629 | 7/1969 | France | 66/50 B |
| 455,502 | 10/1936 | United Kingdom | 66/50 R |

*Primary Examiner*—Mervin Stein
*Assistant Examiner*—Andrew M. Falik
*Attorney, Agent, or Firm*—Clifton T. Hunt, Jr.

[57] ABSTRACT

The invention relates to a control system for the selection of knitting needles in a multi-feed circular knitting machine with the aid of jacks and means for selectively activating and inactivating desired jacks. A removable stand having holes for the reception pins to actuate selected pattern braids is programmed with pins in accordance with desired jack manipulation and replaced.

3 Claims, 7 Drawing Figures

II
9
7
23
23A
5
11
y
17
z
19A
15
13A
23B
19
19C
21
19B
III
47
49
43
33
35
1
39
43A
13
IV
37
IV
51
13C
53
32B
32A
33
33E
61
13B
33F
41
63
45
II
31
65
69
III
3

Fig. 4
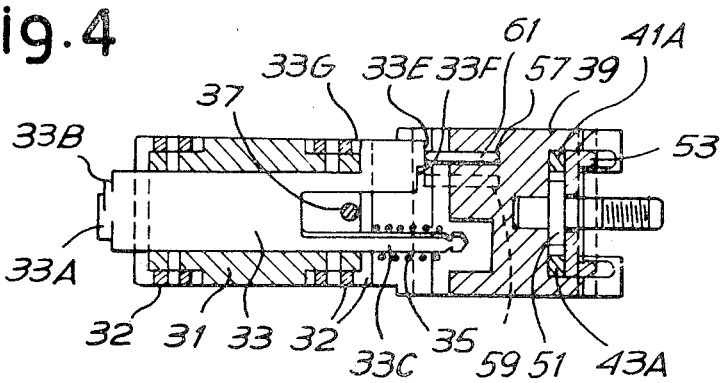
Fig. 5
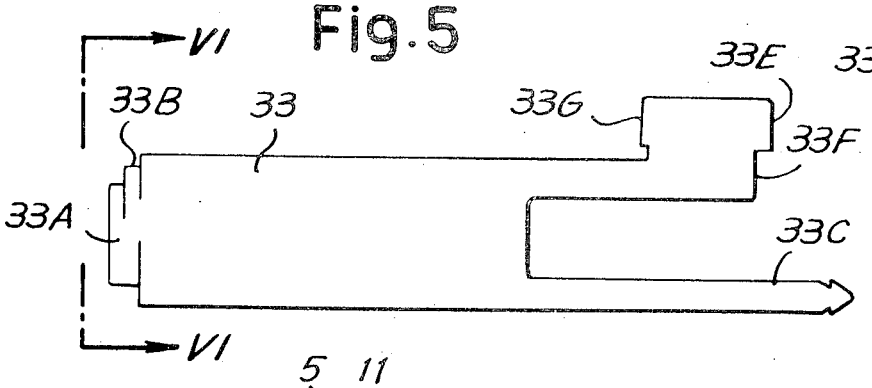
Fig. 6
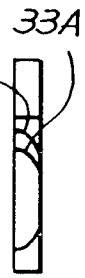
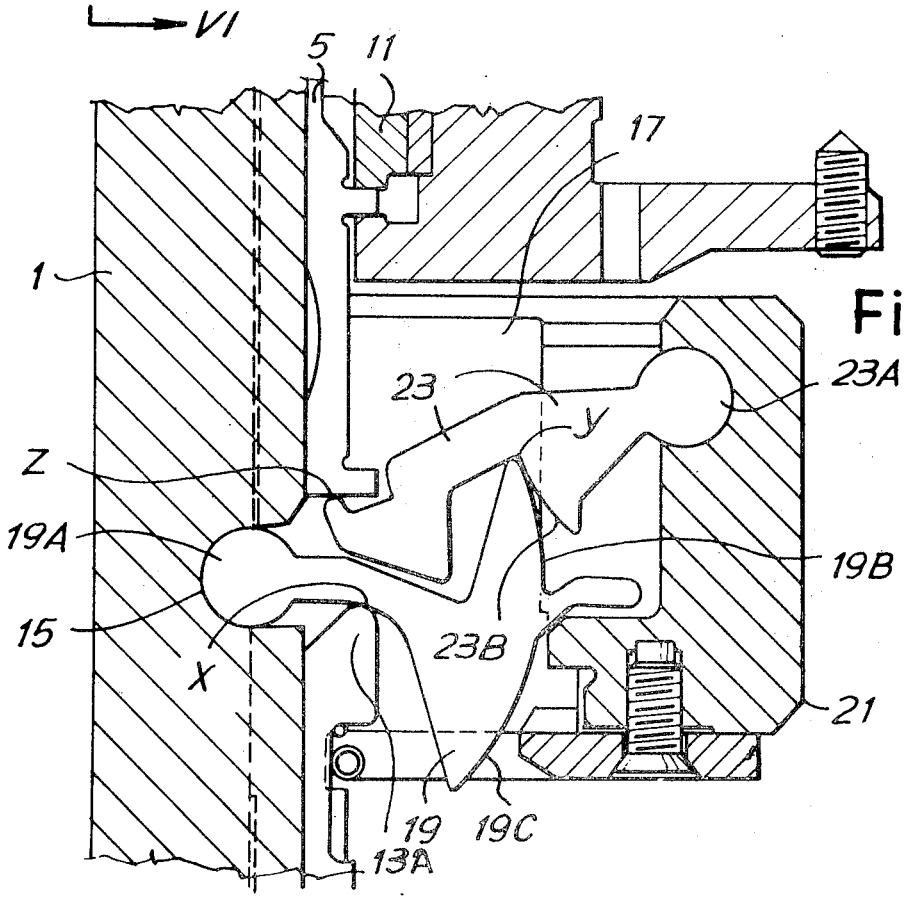
Fig. 7

NEEDLE SELECTING MEANS

BACKGROUND OF THE INVENTION

The selection of needles according to a desired pattern is conventional practice on circular knitting machines and various control systems have been devised for this purpose. All such systems to applicants' knowledge have the disadvantage of requiring that the machine be shut down to provide for a new pattern of needle selection or comprising complicated and expensive apparatus to effect the desired change in needle selection.

SUMMARY OF THE INVENTION

According to the invention, a removable stand member is provided having a plurality of seats to accommodate pins which may be selectively positioned to activate an associated pattern blade which in turn is moved in the path of desired jacks.

In a practical embodiment, the pattern blades are normally urged to an inoperative position by spring means. The spring means is overcome through the appropriate placement of pins in a supporting stand to engage a desired blade and move it into the path of the jack butts. Each blade includes two cammed surfaces, one of which is higher than the other and either of which can be alternatively positioned in the path of the jack butts to provide greater variations in the height the jacks and their associated needles can be raised. The invention includes means for removably attaching stands containing a desired pin arrangement for the activation of a selected needle pattern and the simple means by which the stands can be attached and removed from the machine makes it possible to program the needle selection in an area remote from the knitting machine and to quickly change the needle selection by simply changing the stand containing the pins controlling the selection of needles.

OBJECTS OF THE INVENTION

An object of the invention is to provide an apparatus of simple construction which may be easily removed and installed on an operating knitting machine to vary the selection of needles as desired at each feed station. The set-up is economical and practical.

BRIEF DESCRIPTION OF THE DRAWINGS

The invention will be better understood from the following description taken in connection with the accompanying drawings in which:

FIG. 4 is an enlarged sectional plan view taken substantially along the line IV—IV in FIG. 1;

FIG. 5 is an enlarged elevation of a pattern blade removed from the machine;

FIG. 6 is an end view of the pattern blade looking in the direction of the arrows VI—VI in FIG. 5; and FIG. 7 is an enlarged detail view of the medial portion of FIG. 1 showing the associated lifting mechanism between the jack and needle.

DETAILED DESCRIPTION OF THE INVENTION

Figure 1:
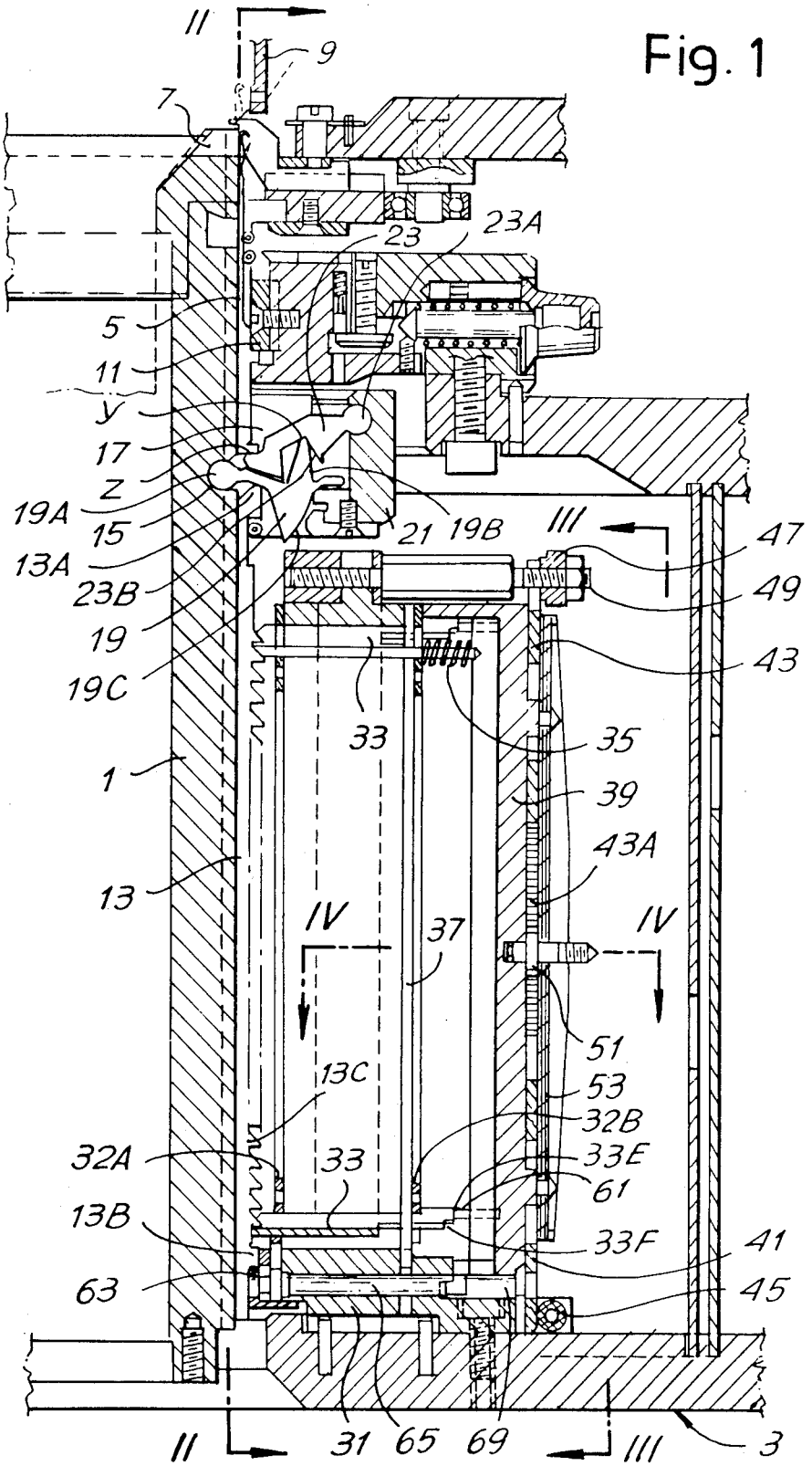
FIG. 1 is a vertical sectional view of one feed of a multi-feed circular knitting machine, partially in elevation and showing one needle and its associated lifting mechanism in accordance with the invention.

Referring now to the drawings, there is shown, in pertinent part, a conventional multi-feed circular knitting machine of the type particularly adapted for the knitting of ladies stockings and panty hose and which comprises a needle cylinder 1 and an annular stationary frame 3. The needle cylinder rotates relative to the frame in the illustrated embodiment, but the invention is equally applicable with that class of machine wherein the frame rotates relative to the cylinder.

The needle cylinder has a plurality of vertically extending grooves within each of which is mounted a knitting needle, only one of which is indicated at 5. The machine also includes a like number of sinkers 7 which cooperate with the needle to form the knit stitches. A yarn guide 9 feeds the yarn to the needles at each of the feed stations, only one being indicated in the drawings. Each feed station includes a stitch cam which draws successive needles downwardly to their knockover or maximum draw position.

The needles are raised at each feed station to any desired height, such as the inactive position or the clearing position, or to any other position above the knockover position by jacks assembled in the needle grooves of the cylinder 1 and responsive to actuation by conventional camming to directly contact its associated needle spaced immediately above the jack in their respective needle grooves to raise it to a predetermined height.

According to the invention, auxiliary linkage is provided between the upper end of each jack and the lower end of its associated needle. The linkage comprises first and second levers (19 and 23) for each needle groove, the first levers 19 each being journaled in the needle cylinder and extending radially outwardly therefrom. The second levers 23 are journaled in the frame 3 and extend toward the needle cylinder for engagement with their respective first levers 19. More specifically, each of the first levers 19 are journaled in a circular recess 15 communicating with respective needle grooves at a position between the lower ends of their respective needles and the upper ends of their associated jacks. The circular recesses or seats 15 communicate with their corresponding needle grooves, and the walls of the grooves each have extensions or flanks 17 extending radially therefrom. Each lever 19 is positioned between a pair of flanks 17, and has a circular extension 19A of corresponding configuration with the circular recesses 15. With the extension 19A seated within its recess 15, the lever 19 extends radially between the extensions or projecting flanks 17.

An annular rim 21 is engaged to the outer ends of the flanks 17 which extend radially from the needle cylinder 1 and the rim 21 is movable with the needle cylinder. The rim 21 has a circular recess or seat for the reception of the circular extension 23A on each of a plurality of levers 23 corresponding in number to the levers 19 and co-acting with the same to raise the needles an amplified amount in relation to the movement of the jack. Each lever 19 is in contact with its lever 23 through respective cam surfaces 19B and 23B which retain the pairs of levers 19 and 23 in their respective seats.

The rim 21 is provided with an annular projection 21X and an annular member 221 is clamped on rim 21 by screws 321. Flanks 17 have annular projections 117 which overlap and are clamped between projections 21X and 221 by the screws 321.

Each lever 19 is raised with the aid of the upper end 13A of the corresponding jack 13, which engages a point X a short distance radially upwardly from the seat 15 of the extension 19A. The upper end of the cam surface 19B contacts the lever 23 at the point Y which is located further from the seat 15 and the circular extension 19A than is the point X. The lever 23 contacts the lower end of its associated needle 5 at the point Z which is further from the extension 23A than is the point Y. It follows from the above that any elevation or lifting of a jack 13 causes a much higher elevation or lifting of its respective needle, owing to the amplification resulting from the interaction of the two levers 19 and 23 making contact at the points X, Y and Z in response to elevation of a jack. Consequently, it is possible to use a relatively low cam surface in the trajectory S1 of the jacks to cause the desired higher elevation of the trajectory S2 of the needles previously obtained by a direct contact of the needles by their respective jacks in the prior art. The use of a low profile in the trajectory S1 of the jack is beneficial in operating at higher speeds. The use of the auxiliary levers for lifting the needles is also advantageous in that it makes possible a circumferential reduction of the space required for the jack cams and yet results in the needles being elevated to the same height as in the conventional system. Of course, any decrease in the circumferential space requirements correspondingly increases the available space for yarn feed stations in a given circumference.

Spaced around the annular frame 3, and in correspondence of the row of removable control butts of the jacks 13, small blocks 31 are located in radially adjustable position, there being one such block for each yarn feed station, and more specifically in correspondence of each lifting trajectory S1 and S2. In each block 31, through suitable racks 32A and 32B, there are formed tangentially positioned radial seats for the reception of a plurality of pattern blades 33, arranged to act on the jack butts. Each blade 33 has on its inner end a first cammed surface 33A and a second cammed surface 33B, the first cammed surface 33A being at a lower elevation than the second cammed surface 33B. The first cammed surface 33A acts on the jack butts when the blade 33 is advanced only partially in a centripetal direction to a first position, while the cammed surface 33B acts on the jack butts when the blade 33 is advanced centripetally to its fullest extent.

Each blade 33 includes a rear leg 33C having a head on its free end which retains a compression spring 35 encircling the rear leg 33C and engagable with the rear rack 32B to urge its respective blade 33 in the centrifugal direction to a suitable stop comprising a bar 37 bearing against the rear rack 32B. Each blade 33 also includes at its rear a stepped profile comprising two step portions 33E and 33F. The step portion 33E defines the rear edge of a laterally extending projection which has a forward edge or stop 33G.

Figure 3:
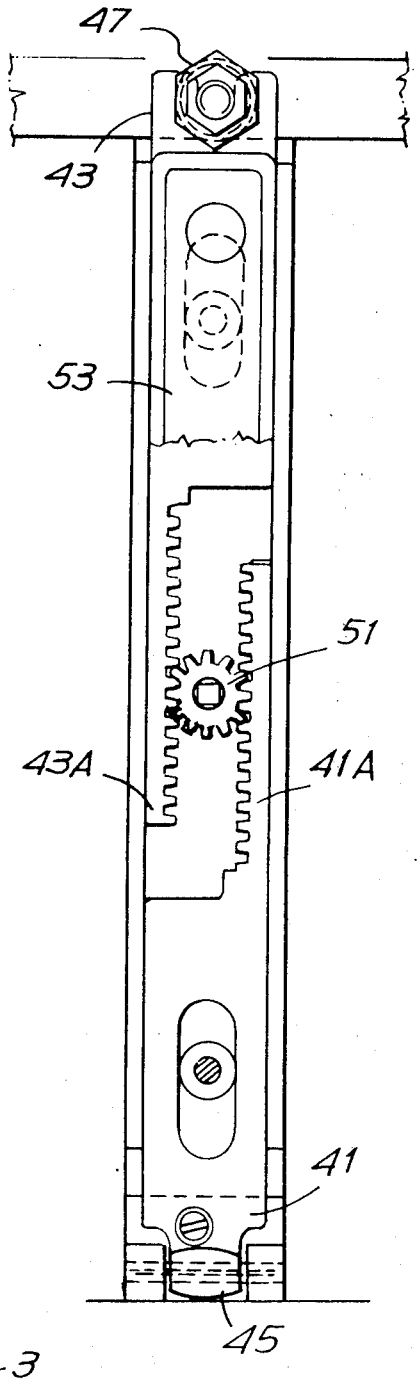
FIG. 3 is a vertical sectional view taken substantially along the line III—III in FIG. 1 and mostly in elevation.

A stand member 39 is removably supported at 40 on each block 31, and the stand members 39 may be quickly connected in place by vertically extending racks 41 and 43. The rack 41 has a lower end releasably confined by a roller stop 45 while the upper rack 43 is bifurcated at its upper end and is releasably retained by a washer 47 retained on a threaded stud 49 by a suitable locknut in an adjustable manner. A sprocket wheel 51 is journaled for engagement with the teeth of the racks 41,43 intermediate the roller wheel 45 and the threaded stud 49 and each of the racks 41 and 43 extend sufficiently beyond the sprocket wheel to be operatively engaged thereby. Rotation of the sprocket wheel 51 in a counter clockwise direction in FIG. 3 will retract the racks 41 and 43 inwardly of the upper and lower edges 39A and 39B of the stand 39. The stand 39 is dimensioned to fit between the roller 45 and the stud 49 when the racks 41, 43 are retracted. Thus, the stand 39 may be quickly positioned with the racks retracted, after which the sprocket wheel 51 may be rotated in the clockwise direction in FIG. 3 to project the racks 41, 43 outwardly beyond the edges 39A, 39B of stand 39. As explained, the roller 45 retains the rack 41 and the washer 47 and its associated nut retain the bifurcated upper end of rack 43. The two racks 41,43 are guided in their vertical movement within the stand 39. A cover 53 retains the rack 41,43 and the sprocket wheel 51 in the stand 39.

Figure 2:
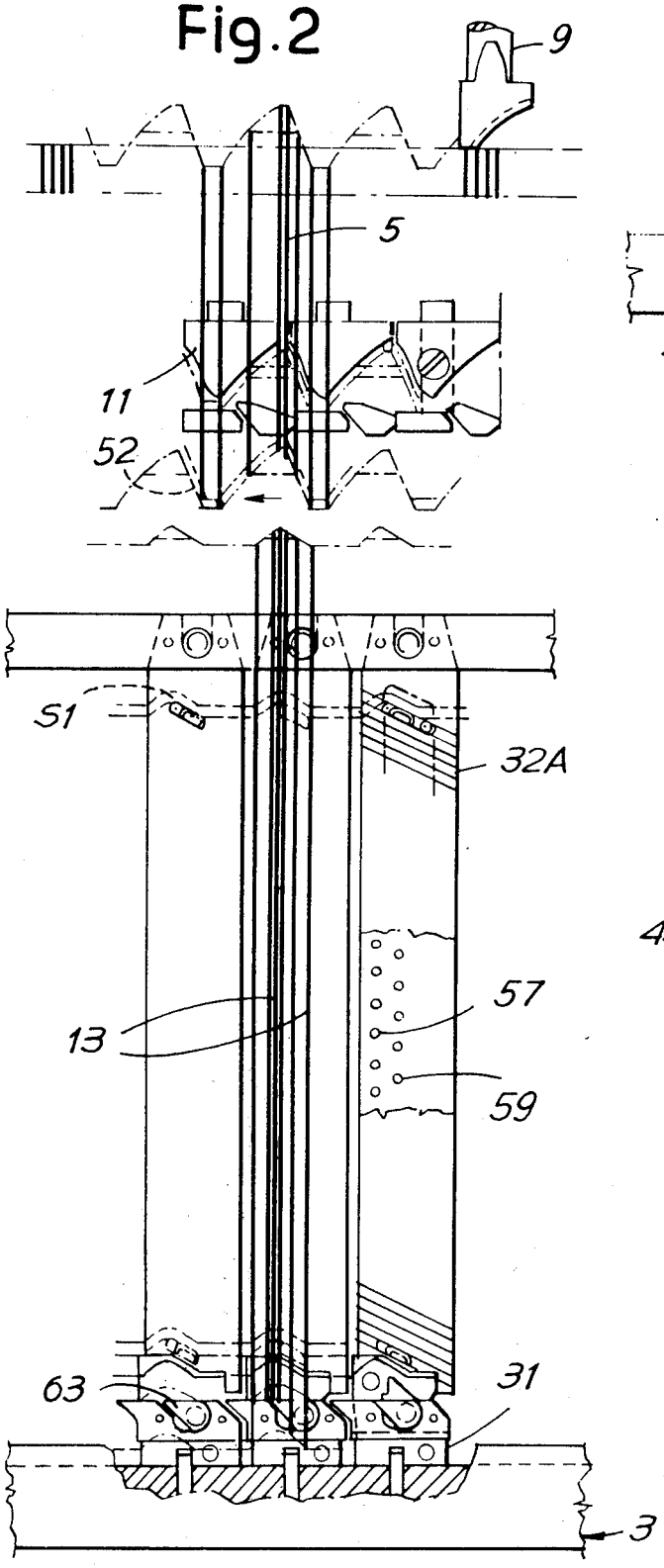
FIG. 2 is a vertical sectional view, mostly in elevation taken substantially along the line II—II in FIG. 1 which coincides with the needle groove illustrated in FIG. 1.

Each stand 39 contains a plurality of vertically arranged holes on the inner surface, said holes being arranged in two staggered rows, indicated respectively at 57 and 59 in FIGS. 2 and 4 and located in correspondence of the steps 33E and 33F on the respective blades 33. The holes 57 and 59 provide seats for pins 61 which may be removably retained within their seats formed by the holes in the rows 57 and 59. The pins 61 are of equal length and are arranged in selected seats before applying a stand 39 to its block 31 to obtain predetermined positionings of the blades 33. For example, a pin 61 in a hole of the row 57 acts (after assembly of the stand) on the corresponding blade 33 by contacting the surface 33E and thus urging the blade 33 centripetally until the cammed surface 33B lifts the jacks to a relatively high position (FIG. 4). By way of further example, a pin 61 in a hole of the row 59 acts, upon assembly of the stand 39, on the corresponding blade by contacting the surface 33F and thus urging the blade 33 centripetally until only the stepped portion 33A contacts the jacks to raise them a relatively lesser height. The absence of a pin 61 results in the corresponding blade 33 not being advanced and thus remaining excluded.

Assuming the desired number of pins 61 to be positioned as desired within the holes in rows 57 and 59 in a stand 39, and assuming the stand 39 to have been attached to its respective block 31, the pins 61 will instantly contact one of the stepped portions 33E or 33F. However, centripetal movement of the blades 33 contacted by the pins 61 may be prevented because the jacks are in a non-raised position or are not raised to a position coinciding to the selection conditions required by the particular arrangement of the pins 61 in the stand 39 which is assumed to have been attached to its respective block 31.

In order to preposition the jacks to be receptive to the desired placement of the pins 61, a cam 63 is mounted on a manually rotatably shaft 65, the cam 63 being adjustable by rotation of shaft 65 to act on a lower butt 13B of the jacks 13 causing all of the jacks 13 to climb in correspondence of the centripetally projecting blades 33 through engagement with their respective cammed surfaces 33A or 33B. This prevents interference of the blades 33 with the butts 13C.

Whereupon the shaft 65 is manually rotated through a passage 69 formed between the block 31 and the stand 39 to inactivate the cam 63 and permit needle selection by the blades 33. With the foregoing apparatus, it is easy to make a desired needle selection and it is easy to modify the needle selection according to the working requirements. It is possible, also, to arrange a set of stands 39 with the pins 61 located in the desired manner to provide the desired needle selection before removing from the knitting machine stands having pin placements for a different pattern of needle selection. Thus, the present invention provides an effective and efficient means of needle selection which may be readily changed with a minimum of down time.

A preferred embodiment of the invention has been described, but without limitation; the scope of the invention being defined by the claims.

What is claimed is:

1. In a multi-feed circular knitting machine having a frame and a needle cylinder provided with a plurality of vertical grooves circumferentially arranged about the needle cylinder and a vertically reciprocable knitting needle and jack mounted in each said groove, each jack having a lower butt and a plurality of pattern butts, a pattern mechanism comprising a block attached for radial adjustment to the frame and radially aligned with a feed station, a plurality of radially movable pattern blades arranged in superposed relation to each other on the block and selectively engagable with jacks at the feed station, spring means normally urging the blades away from the jacks, said pattern mechanism also including a stand removably attached to said block and said stand having two rows of vertically arranged holes on its inner surface for the selective reception of pins which are removable but stationary in use and engagable with opposed blades supported by the block to overcome said spring means and protect the blades radially inwardly to actuate the jacks according to a desired pattern, each blade including a stepped profile on one and selectively engagable with a jack and a corresponding stepped profile on the other end selectively engageable with a pin in said stand whereby each of the said two rows corresponds to one of the stepped portions on said other end of the blade.

2. A structure according to claim 1 wherein manually operable cam means are provided for simultaneously manipulating jacks operatively associated with said cam means during attachment of the stand and initial engagement of its pins with the blades.

3. In a multi-feed circular knitting machine having a frame and a needle cylinder provided with a plurality of vertical grooves circumferentially arranged about the needle cylinder and a vertically reciprocable knitting needle and jack mounted in each said groove, each jack having a lower butt and a plurality of pattern butts, a pattern mechanism comprising a block attached for radial adjustment to the frame and radially aligned with a feed station, a plurality of radially movable pattern blades arranged in superposed relation to each other on the block and selectively engageable with jacks at the feed station, spring means normally urging the blades away from the jacks, said pattern mechanism also including a stand removably attached to said block and said stand having a plurality of vertically arranged holes on its inner surface for the selective reception of pins which are removable but stationary in use and engageable with opposed blades supported by the block to overcome said spring means and project the blades radially inwardly to actuate the jacks according to a desired pattern, said stand including a centrally disposed sprocket wheel and a pair of vertically reciprocable racks engageable with the sprocket and extensible thereby to retain the stand on the block and retractable thereby to remove the stand from the block.

* * * * *